US006942001B1

(12) United States Patent
Crider et al.

(10) Patent No.: US 6,942,001 B1
(45) Date of Patent: Sep. 13, 2005

(54) MAGNETIC SEALING APPARATUS FOR PORTAL COVERING

(75) Inventors: Grant W. Crider, Bremen, AL (US); Charles Harbison, Alexander City, AL (US)

(73) Assignee: Grantlin, Inc., Miramar Beach, FL (US)

( * ) Notice: Subject to any disclaimer, the term of this patent is extended or adjusted under 35 U.S.C. 154(b) by 0 days.

(21) Appl. No.: 10/655,208

(22) Filed: Sep. 4, 2003

(51) Int. Cl.[7] ..... A47G 5/02

(52) U.S. Cl. ..... 160/241; 160/330; 160/368.1; 160/DIG. 7

(58) Field of Search ..... 160/241, 237, 160/327, 330, 345, 368.1, DIG. 7, 310, 243, 160/268.1

(56) References Cited

U.S. PATENT DOCUMENTS

| | | | | | |
|---|---|---|---|---|---|
| 4,839,544 | A | * | 6/1989 | Sakai | 310/12 |
| 4,992,768 | A | | 2/1991 | Mozis et al. | |
| 5,128,644 | A | | 7/1992 | Nellessen | |
| 5,383,510 | A | * | 1/1995 | Allen | 160/310 |
| 5,566,736 | A | | 10/1996 | Crider et al. | |
| 5,680,893 | A | * | 10/1997 | Neer | 160/330 |
| 5,752,557 | A | | 5/1998 | Crider et al. | |
| 5,785,105 | A | | 7/1998 | Crider et al. | |
| 5,960,847 | A | | 10/1999 | Crider et al. | |
| 5,967,217 | A | * | 10/1999 | Wu | 160/331 |
| 6,089,305 | A | * | 7/2000 | Gruben et al. | 160/271 |
| 6,138,739 | A | | 10/2000 | Crider et al. | |
| 6,148,452 | A | * | 11/2000 | Kirsopp | 4/609 |
| 2003/0221792 | A1 | * | 12/2003 | Schulte | 160/1 |
| 2004/0040672 | A1 | * | 3/2004 | Nager | 160/98 |

FOREIGN PATENT DOCUMENTS

| | | | | |
|---|---|---|---|---|
| EP | 1277844 | * | 1/2003 | 160/241 X |

* cited by examiner

*Primary Examiner*—Bruce A. Lev
(74) *Attorney, Agent, or Firm*—Kenneth M. Bush; Bush IP Law Group, LLC

(57) ABSTRACT

An apparatus comprising a magnetic sealing system for urging opposing sides of a cover toward the lateral margins of a portal to promote sealing of the sides of the cover to the lateral margins of the portal. The magnetic sealing system biases the opposing ends of a first or second rod directly toward the lateral margins to effect a proper seal.

38 Claims, 12 Drawing Sheets

MAGNETIC SEALING APPARATUS FOR PORTAL COVERING

FIELD OF THE INVENTION

The present invention relates to the field of closures for windows, doors, or other portals and more particularly to closures which can be selectively positioned. In greater particularity the present invention relates to an apparatus for magnetically sealing a non-sliding roll-up closure for a portal.

BACKGROUND OF THE INVENTION

Various applications are known wherein a portal requires a closure, or cover, to prevent the passage of wind, rain, light, insects, or any other elements through the portal. As used herein, portal simply means an opening which would allow the passage of such elements therethrough; hence a portal may be a window and the closure of the instant invention may control the passage of any of the above elements therethrough. The present invention addresses the need for improved closures for portals such as may be found on patios, pool houses, green houses, warehouses, livestock houses, atriums or any other similar structures. The portal may be as small as would accommodate a ventilation fan in a gymnasium or livestock house, or as large as an atrium wall in a solar efficient building or an inclined roof panel. Additionally, the position of the portal can range from vertical to horizontal or any angle therebetween.

SUMMARY OF THE PRESENT INVENTION

It is the object of the present invention to provide a means for effectively covering portals such as windows and doors in a number of differing types of buildings.

Another object of the invention is to provide a reliable and easily operated closure for such portals.

These and other objects of the present invention are accomplished through the use of an improved roll-up closure. The closure utilizes a flexible cover or curtain selected from a material suitable to effect the type of closure sought. The cover is at least as wide as the portal to be covered and is typically longer than the portal. Each opposing longitudinal side of the cover preferably has a strip of hook and loop fastener material affixed thereto, and a complementary strip affixed to the lateral margins of the structure defining the portal. A first end of the cover is rigidly affixed across a first margin of the portal. The opposite end of the cover is preferably upturned and connected to a driven take-up roller mounted to the first margin of the portal, either directly or by cables or straps. In one embodiment, a first elongated rod is supported within the upturned end of the cover. In an alternate embodiment, a second elongated rod is included above the first elongated rod and separated therefrom by the cover. In either embodiment, activation of the driven roller lengthens or shortens the effective length of the cover while positioning the mating hook and loop fasteners to seal and unseal the cover to the lateral margins of the portal.

The present invention further comprises means for magnetically urging the opposing ends of a pocket created by the upturned ends of the cover toward the lateral margins of the structure defining the portal to maintain tension on the cover such that the cover forms an adequate seal with the lateral margins of the portal. In one embodiment, the present invention provides means for magnetically connecting opposing ends of the first rod to the lateral margins. In an alternate embodiment, the present invention provides means for magnetically connecting opposing ends of the second rod to the lateral margins. The magnetic sealing apparatus of the present invention biases the opposing ends of the first or second rod directly toward the lateral margin so as to effect a proper seal. In this manner, the present invention biases the opposing ends of a pocket created by the upturned ends of the cover toward the lateral margins at an angle substantially perpendicular thereto, thereby eliminating the reliance on a lateral component of the weight of the first or second rod or other biasing means for a portal covering known in the prior art.

These and other objects and advantages of the invention will become apparent from the following detailed description of the preferred embodiment of the invention.

BRIEF DESCRIPTION OF THE DRAWINGS

A closure embodying features of the invention is described in the accompanying drawings which form a portion of this disclosure and wherein.

DESCRIPTION OF THE PREFERRED EMBODIMENT

Figure 1A:
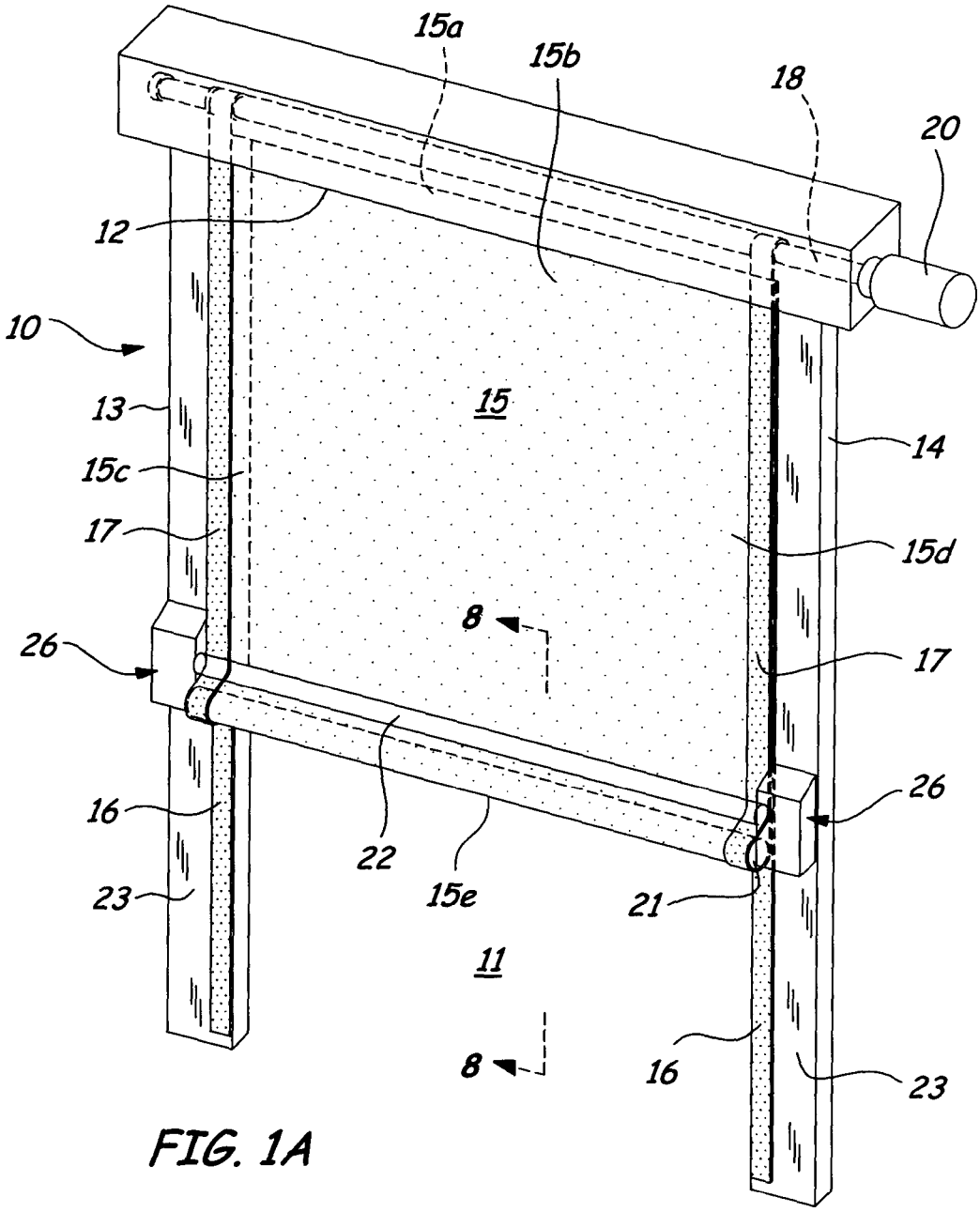
FIG. 1A is a perspective view of the invention in a partially raised position.

The invention disclosed herein is technology related to U.S. Pat. Nos. 5,566,736, 5,752,557, 5,785,105, 5,960,847, and 6,138,739, all of which are incorporated herein by reference. A more complete understanding of the invention may be obtained by reference to the accompanying drawings wherein the closure 10, according to the preferred embodiment, covers a portal or opening 11 having a pair of lateral margins 13 and 14. Lateral margins 13 and 14 extend the full vertical length of opening 11 and may terminate at a lower margin (not shown), which extends across the width of the opening. Across the top of opening 11 is an upper margin 12 which extends from margin 13 to margin 14. Thus, it may be seen that the opening is completely framed by the aforementioned upper, lower, and lateral margins 12, 13, and 14. It is to be understood that the present invention may be positioned vertically, horizontally, or inclined, thus the terms lower or upper margin do not imply only vertical disposition of the unit.

Attached to upper margin 12 is a first end 15*a* of a curtain 15, the curtain being comprised of a flexible material selected in accordance with the purposes of the present invention for its ability to block or transmit light, air, moisture, insects, or the like from one side to the other thereof. Therefore, curtain 15 is properly defined as a flexible barrier material, having a first end 15*a* secured to upper margin 12 and opposing longitudinal sides 15*c* and 15*d*, which are longer than the length of lateral margins 13 and 14, and a lower end 15*b*. Attached to lateral margins 13 and 14 and to sides 15*c* and 15*d* are complementary closure members 16 and 17, such as hook and loop fastener material, which can be selectively attached and detached. Each of the opposing longitudinal sides 15*c* and 15*d* of the cover has a strip of hook and loop fastener material 17 affixed thereto, and a complementary strip 16 is affixed to the lateral margins 13 and 14 of the structure defining the portal 11. Note that the closure members need only be approximately commensurate in length with the length of the margins, thus lower end 15*b* of curtain 15 does not need the fastener material. A transverse closure (not shown) may be provided in conjunction with lower margin (not shown); however, on a door, a lower margin would not be present.

Figure 2A:
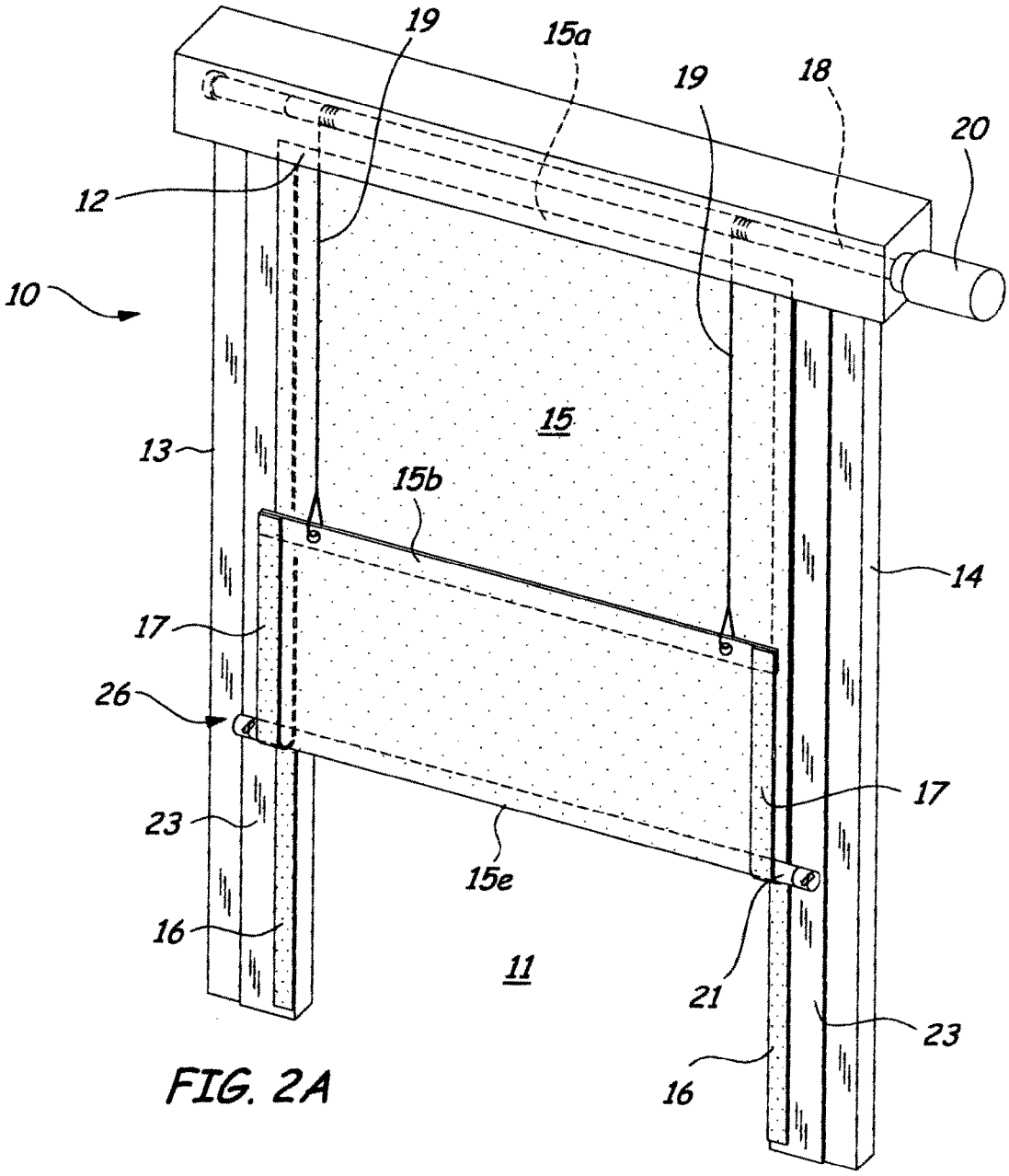
FIG. 2A is a perspective view of an alternate embodiment of the invention in a partially raised position.
Figure 3:
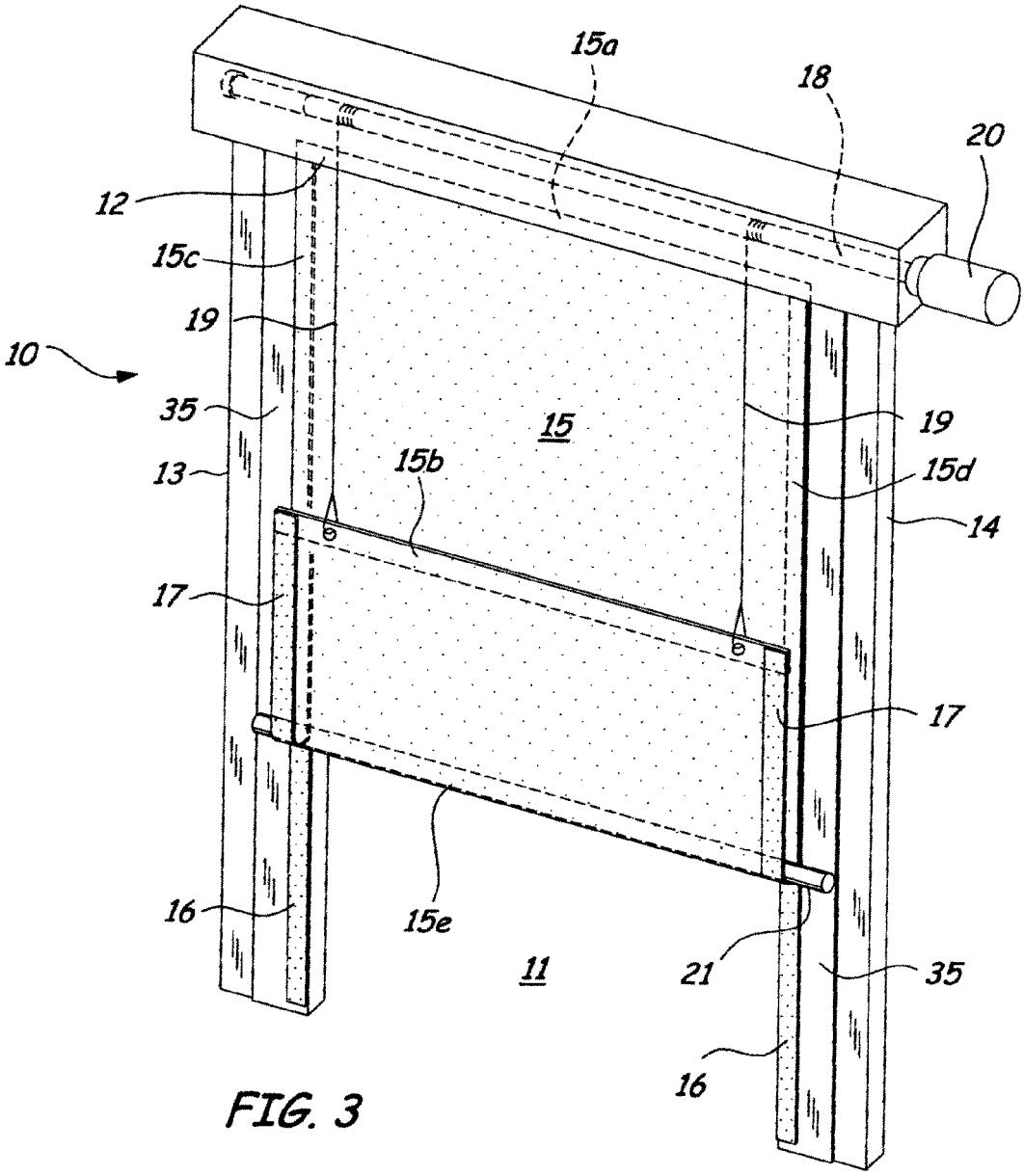
FIG. 3 is a perspective view of another alternate embodiment of the invention in a partially raised position.

As illustrated in FIGS. 1A, 2A, and 3, lower end 15*b* may be connected to a driven transverse take-up roller 18 mounted for rotation above the tops of margins 13 and 14. The lower end 15*b* may be directly connected to the driven roller 18 as shown in FIG. 1A, or, alternatively, by cables or straps 19 as shown in FIGS. 2A and 3. In any case, roller 18 is driven by a reversible motor 20 attached to a selected means of control (not shown), and supports end 15*b*.

The present invention provides an apparatus 10 for opening and closing an opening or portal 11 having a first or upper end 12, a second or lower end (not shown), and a pair of spaced apart opposing lateral margins 13 and 14 in a structure. The flexible curtain 15 of the present invention is at least as wide as the portal 11 to be covered and is typically longer than the portal 11. The flexible curtain 15 has elongated side portions 15*c* and 15*d*, a first end 15*a* and a second or lower end 15*b* each having a dimension commensurate with the separation of the lateral margins 13 and 14. The first end 15*a* is fixedly attached across the portal 11 at a first end or upper margin 12 thereof. The second end 15*b* is folded back on itself, or upturned, to define a pocket opening toward the first end 15*a*. The second end 15*b* can be connected to a driven take-up roller 18 mounted to the first margin 12 of the portal, either directly as shown in FIG. 1A or by cables or straps 19 as shown in FIGS. 2A and 3A.

In one embodiment, a first elongated rod 21 is supported or captured within the pocket created by upturned end 15*e* such that the first rod 21 is lifted within the pocket as roller 18 is rotated to wrap the upturned end 15*e* or straps 19 thereabout and raise the curtain 15. In an alternate embodiment, a second elongated rod 22 is included above the first elongated rod 21 and separated therefrom by the cover 15. It will be appreciated that as driven roller 18 rotates, the first rod 21 and second rod 22 are constrained to rotate in opposite directions with the upturned end of flexible curtain 15 passing between them.

The present invention further comprises means for magnetically urging the pocket formed by the upturned ends of the cover 15 toward the lateral margins 13 and 14 to maintain tension on the cover 15 such that, as further described below, the cover 15 forms an adequate seal with the lateral margins 13 and 14 of the portal. In one embodiment, the present invention provides means for magnetically connecting opposing ends of the first rod 21 to the lateral margins 13 and 14. In an alternate embodiment, the present invention provides means for magnetically connecting opposing ends of the second rod 22 to lateral margins 13 and 14.

Carrying closure 17 of the curtain sides 15*c* and 15*d* is pressed against complementary closure 16 of the lateral margins 13 and 14 as the first rod 21 is lowered, thereby ensuring a sealing connection as a result of the first rod 21 or second rod 22 being magnetically urged toward the lateral margins 13 and 14. The magnetic sealing apparatus of the present invention provides a biasing force for urging the opposing ends of the first rod 21 or second rod 22 toward the lateral margins 13 and 14 at an angle substantially perpendicular thereto so as to effect a proper seal. As driven roller 18 raises the curtain 15, the lifting force is transferred around the first rod 21 to provide an opening force to the closures 16 and 17 substantially perpendicular thereto, such that they are readily detached.

From the foregoing, it can be appreciated that the present invention comprises means operatively connected to the second end 15*b* of the curtain for varying the height of the pocket. It is easily seen that as driven roller 18 rotates, it effectively varies the length of curtain 15 such that the first rod 21 and second rod 22, if present, urge closure members 16 and 17 into and out of sealing engagement. It is also contemplated that the lower end 15*b* of the curtain be fixedly attached to the first rod 21. In this embodiment (not shown), at least one cord encircles the first rod 21 and is attached at one end to driven roller 18 and at a second end to a point above the maximum height of the first rod 21 when fully raised. As driven roller 18 rotates, cords are wound around the driven roller 18, effectively shortening the length of cords. As a result, the first rod 21 is rotatably raised and the lower end of curtain 15 is wound around the first rod 21. In each of the above-referenced embodiments, activation of the driven roller 18 lengthens or shortens the effective length of the cover 15 while positioning the mating hook and loop fasteners 16 and 17 to seal and unseal the cover 15 to the lateral margins 13 and 14 of the portal.

The present invention provides means for magnetically urging the pocket formed by the upturned end of the curtain 15 toward the lateral margins 13 and 14. In the preferred embodiment shown on FIGS. 1A and 1B, each lateral margin 13 and 14 has a magnetically attractable support surface 23 integral therewith. It is also contemplated that in other embodiments, the magnetically attractable support surface may be affixed to the lateral margins 13 and 14, such as but not limited to being in the form of a metal or magnetic strip 35 commensurate with the vertical length of the lateral margins 13 and 14. In the preferred embodiment, means for magnetically urging comprises at least one magnet 24 operatively connected to each opposing end of the second rod 22. More specifically, in the preferred embodiment each at least one magnet 24 is rotatably mounted to each opposing end of the second rod 22.

The preferred embodiment comprises a magnet housing assembly 26 to which the at least one magnet 24 is connected. The magnet housing assembly 26 is itself rotatably mounted to each opposing end of the second rod 22 so that the second rod 22 may freely rotate as the curtain 15 is raised and lowered. The magnet housing assembly 26 and at least one magnet 24 may be of any configuration that allows the opposing ends of the second rod 22 to remain magnetically connected to the lateral margins 13 and 14 as the curtain 15 is raised and lowered. Thus, the at least one magnet 24 of the present invention is operatively connected to each opposing end of the second rod 22 rod with the at least one magnet 24 providing discrete areas that contain sufficient magnetic flux density to retain each end of the second rod 22 to the magnetically attractable surface 23 of the lateral margins 13 and 14. As further discussed below, the various configurations of magnet housing assemblies 26 and magnets 24 may alternatively be operatively connected to opposing ends of the first rod 21.

Figure 4:
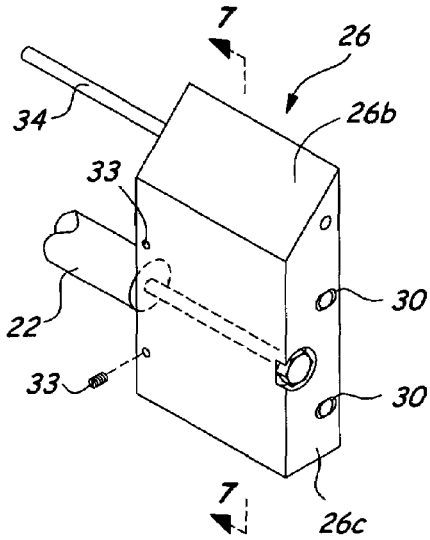
FIG. 4 is a rear perspective view of a magnet housing assembly of the present invention.
Figure 5:
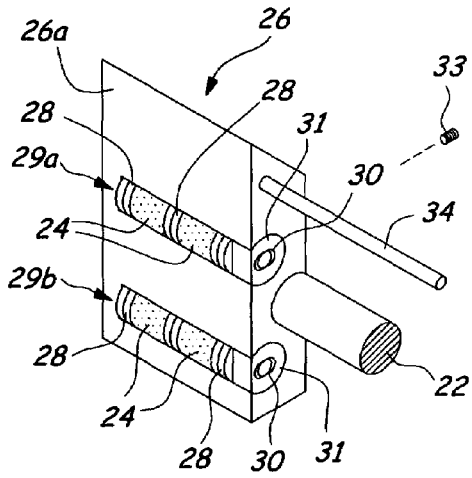
FIG. 5 is a front perspective view of a magnet housing assembly of the present invention.
Figure 6:
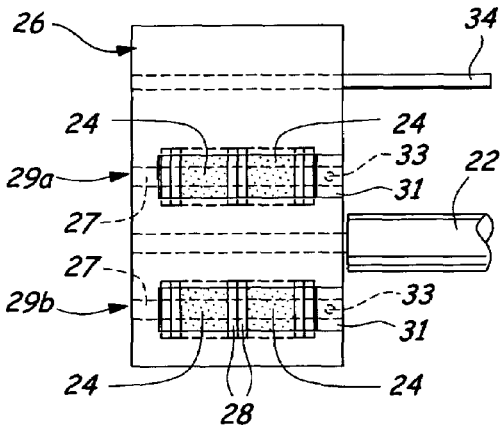
FIG. 6 is a front elevational view of a magnet housing assembly of the present invention.

As shown in FIGS. 4–10, the preferred embodiment comprises a plurality of cylindrical magnets 24, each having a central bore 24*a* mounted in axial alignment for rotation about a mounting rod 27 passing therethrough. More specifically, the preferred embodiment comprises a first pair 29*a* of cylindrical magnets 24 having a central bore 24*a* mounted in axial alignment for rotation about a first mounting rod passing therethrough; and a second pair 29*b* of cylindrical magnets 24 having a central bore 24*a* mounted in axial alignment about a second mounting rod passing therethrough. As shown in FIGS. 1A and 6, the cylindrical magnets 24 are mounted for rotation about a longitudinal axis positioned generally parallel to the longitudinal axis of the second rod 22, traverse to the lateral margins 13 and 14. In this manner, the second rod 22 and magnet housing assembly 26 can travel vertically as driven roller 18 is rotated to raise and lower the curtain 15.

Figure 10:
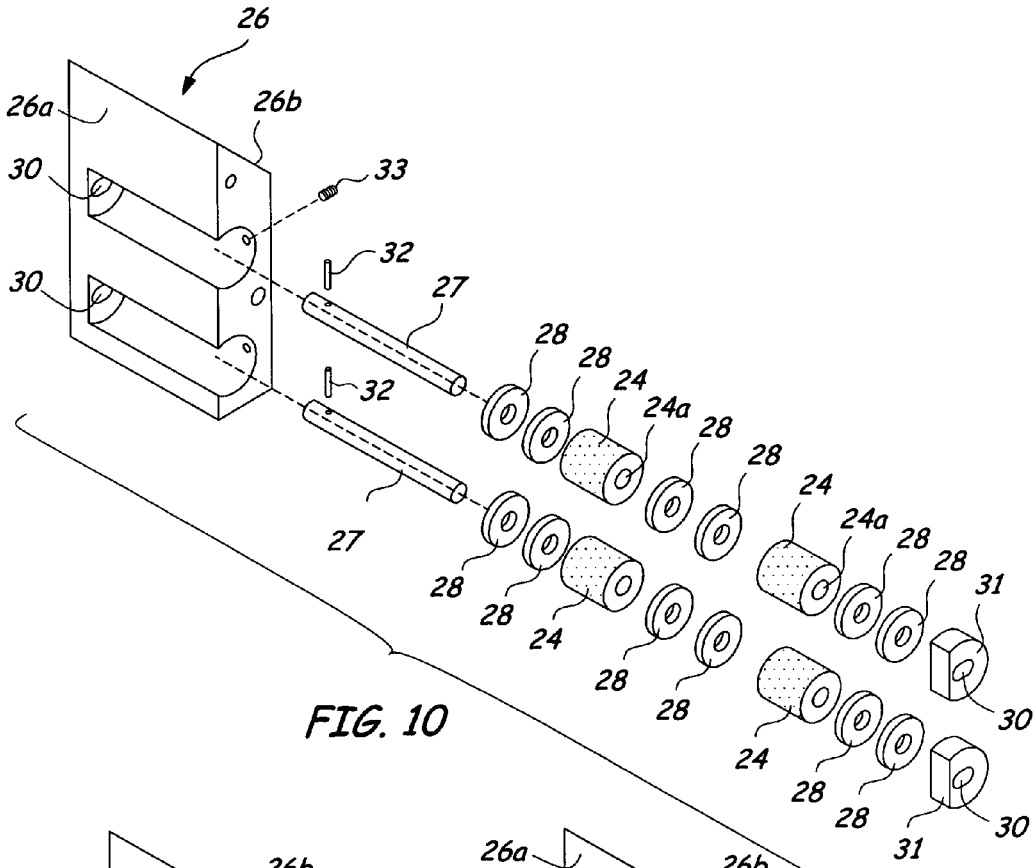
FIG. 10 is an exploded perspective view of a magnet housing assembly of the present invention.

The present invention further comprises at least one cylindrical spacer member 28 interposed between two adjacent cylindrical magnets 24. With reference to FIG. 10, the preferred embodiment has two spacer members 28 in the general shape of conventional metallic washers interposed between adjacent cylindrical magnets 24 and at each end thereof. Each pair 29*a* and 29*b* of cylindrical magnets 24 is mounted within one of two cylindrically shaped openings formed in the magnet housing assembly 26. One end of each mounting rod 27 at least partially passes through a slot 30 formed in a side of the housing assembly 26 at one end of the cylindrically shaped opening. This end of the mounting rod 27 is held in place and prevented from lateral movement by a roll pin 32 passing through an opening formed in the mounting rod 27.

The other end of each mounting rod 27 at least partially passes through a slot 30 formed in a bushing or retaining member 31 that is held in place by a set screw 33. Interposed between the roll pin 32 and retaining member 31 are a plurality of cylindrical spacer members 28 and cylindrical magnets 24 having a central bore through which the mounting rod 27 passes. It can be appreciated that this mounting arrangement allows for rotation of the magnets 24 and spacer members 28 about the mounting rod 27.

Figure 7:
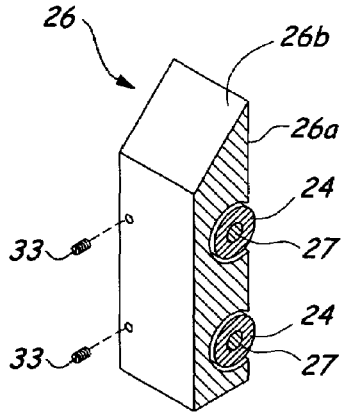
FIG. 7 is a perspective view of a magnet housing assembly of the present invention shown in a sectional view taken along line 7—7 of FIG. 4.
Figure 9:
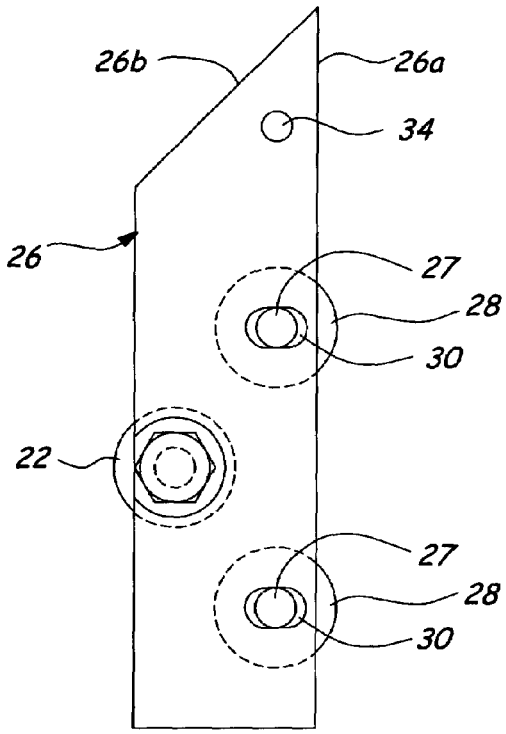
FIG. 9 is a left side elevational view of a magnet housing assembly of the present invention.

As shown most clearly on FIGS. 7 and 9, the cylindrical magnets 24 and spacer members 28 are mounted in a partially recessed position within the housing assembly 26, so that at least a portion of the magnets 24 and spacers 28 extends beyond the forward surface 26*a* of the housing assembly. This allows a portion of the magnets 24 and spacers 28 to be in contacting engagement with the magnetically attractable support surface 23 of the lateral margins 13 and 14. With reference to FIGS. 4 and 9, the slots 30 formed in the side of the housing assembly and retaining member 31 are generally horizontally disposed. This allows lateral movement of the mounting rods 27 to a limited extent generally perpendicular to the lateral margins 13 and 14 during use. This facilitates maintaining the magnetic connection of the magnet housing assembly 26 with the lateral margins 13 and 14 in situations where there are irregularities in the surface of the lateral margins 13 and 14 such as warping. It may be appreciated that during use, the slots 30 allow each respective mounting rod 27 to move independently to a limited extent normal to the surface of the lateral margin 13 and 14 to maintain a magnetic connection.

Although the preferred embodiment provides a magnet housing assembly making contacting engagement between the at least one magnet 24 and the lateral margins 13 and 14, such contacting engagement is not required. It is contemplated, by way of example without limiting the scope of the disclosure herein, that a magnet may be completely disposed within the magnet housing assembly so that only the housing assembly 26 makes contacting engagement with the lateral margin 13 and 14. Alternatively, the spacer members 28 may have a larger diameter than the magnets 24 so that only the spacer members 28 actually contact the magnetically attractable support surface 23 of the lateral margins 13 and 14.

Figure 1B:
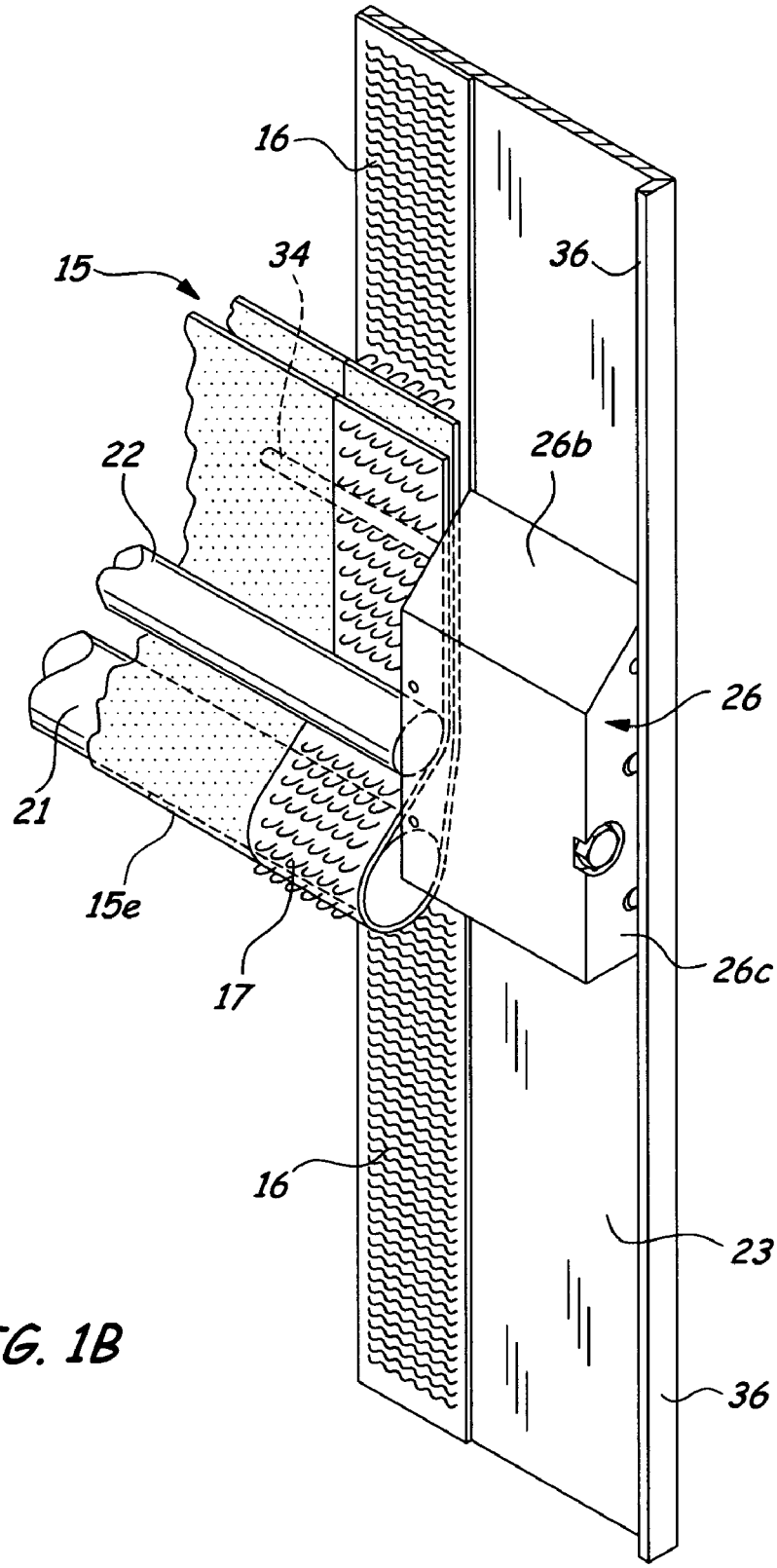
FIG. 1B is a perspective view of the magnet housing assembly of the embodiment of FIG. 1A.
Figure 8:
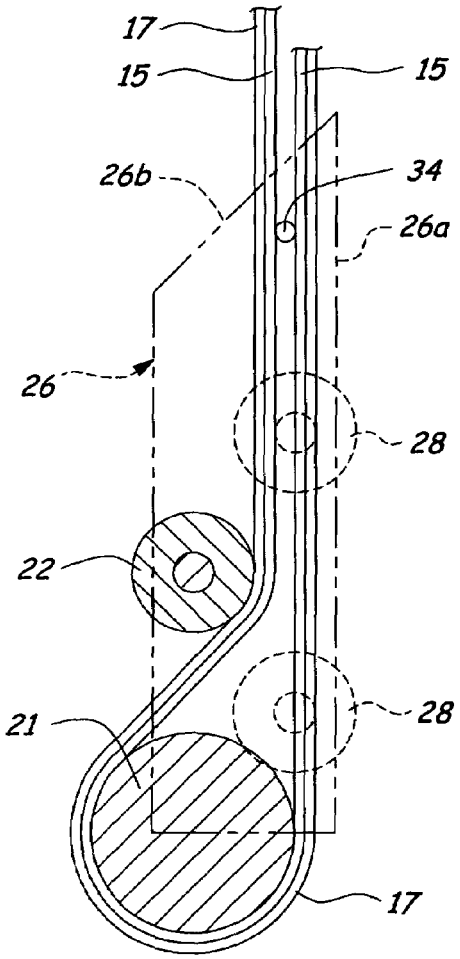
FIG. 8 is a sectional view taken along line 8—8 of FIG. 1A.

The manner in which the magnet housing assembly 26 of the present invention operates is shown in FIGS. 1B and 8. As can be seen in FIG. 1B, curtain sides 15*c* and 15*d* and carrying closure 17 are pressed against complementary closure 16 of the margin as the first rod 21 is lowered, thereby ensuring a sealing connection as a result of the second rod 22 being magnetically urged toward the magnetically attractable support surface 23 of the lateral margins 13 and 14. The magnetic sealing apparatus of the present invention provides a biasing force for urging the opposing ends of the second rod 22 toward the lateral margin 13 and 14 at an angle substantially perpendicular thereto so as to effect a proper seal. With reference to FIG. 8, the curtain 15 passes downward from its upper end 15*a* along the lateral margins 13 and 14 between the second elongated rod 22 and the lateral margin 13 and 14, to a point where it is upturned to form a pocket that captures the first elongated rod 21. The first elongated rod 21 is not operably connected to the magnet housing assembly 26, but instead is allowed to rotatably "float" within the pocket as the curtain 15 is raised and lowered.

The upturned end of the curtain 15 passes upward around the first elongated rod 21 and then between the second elongated rod 22 and the lateral margins 13 and 14 so that both a downward and upward portion of the curtain 15 are disposed between the second elongated roller 22 and the lateral margins 13 and 14. Because a strip of hook and loop fastener material 17 is affixed to only one surface of the curtain 15 along each longitudinal side 15*c* and 15*d* thereof, the hook and loop fastener material 17 does not engage either the surface of the first elongated roller 21 or itself as the curtain 15 is raised and lowered.

The magnet housing assembly 26 further comprises an elongated retaining rod 34 extending from the housing assembly 26 between the downward and upward portions of the curtain 15, as shown in FIGS. 1B and 8. The retaining rod 34 is positioned above the second elongated rod 22 so that if the housing assembly 26 becomes detached from the lateral margins 13 and 14, the pocket formed by the upturned end 15*b* of the curtain will catch the rod 34. This retains the magnet housing assembly 26 and second elongated rod 22 therein to prevent the assembly 26 and rod 22 from falling. In this event, the retaining rod 34 allows the housing assembly 26 to be readily remounted magnetically to the lateral margins 13 and 14. In the preferred embodiment, the magnet housing assembly 26 also has an inclined upper surface 26*b* that prevents debris from accumulating thereon and facilitates cleaning of the assembly 26.

The magnet of the present invention may be a permanent magnet or electromagnet, preferably a permanent magnet. Types of permanent magnets include ferrite (both bonded and sintered), rare earth, cunife, Alnico (Aluminum-Nickel-Cobalt), ceramic, samarian cobalt, and neodymium iron boron. The magnet is preferably of the rare earth type, because such magnets have the highest available energy-per-unit volume and weight as well as the highest available resistance to demagnetization. Rare earth magnets also have excellent temperature stability and can be machined to be very thin.

Figure 11:
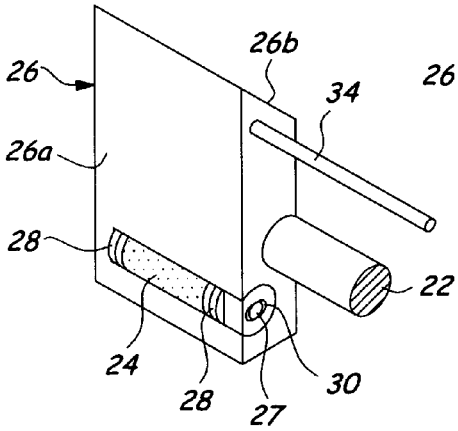
FIG. 11 is a front perspective view of an alternate embodiment of the magnet housing assembly of the present invention.
Figure 20:
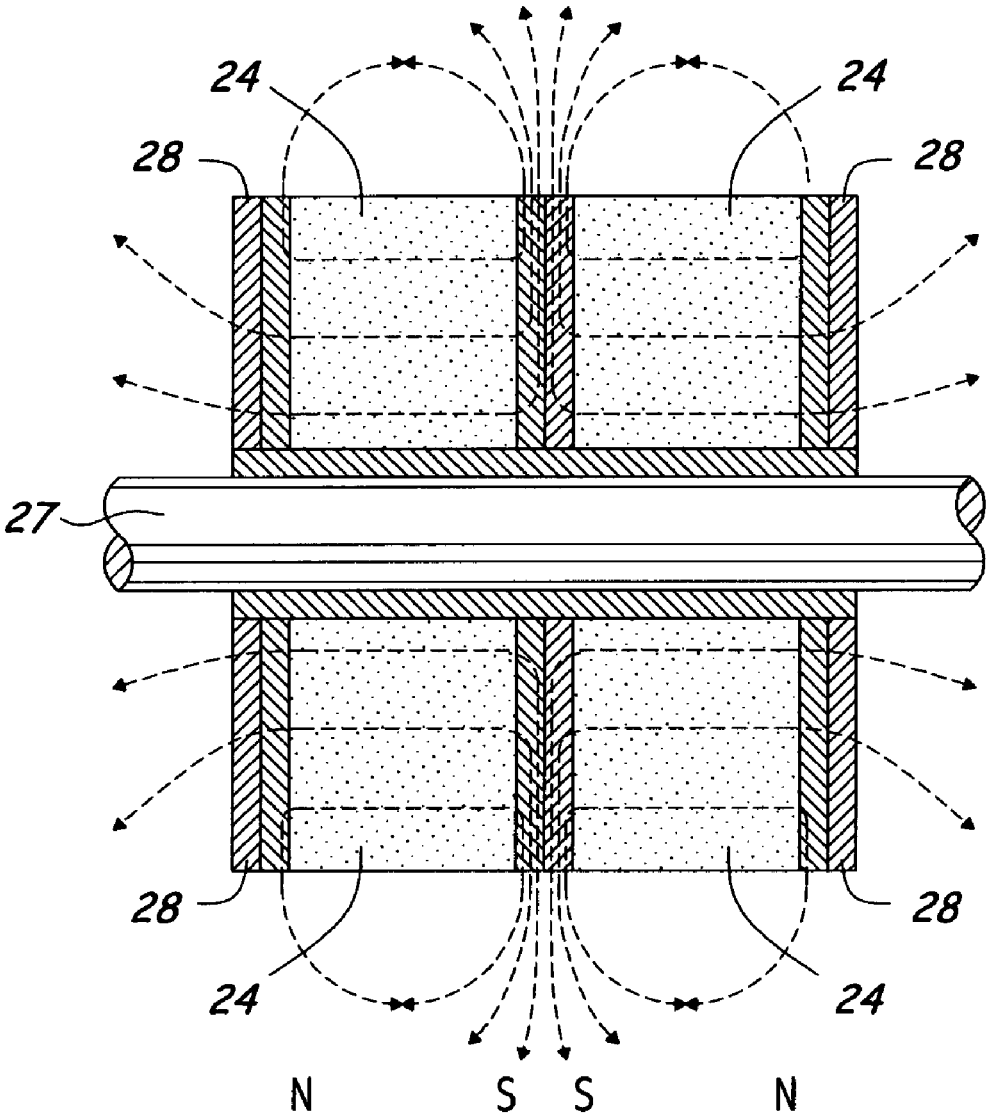
FIG. 20 is a vertical sectional view of a magnet assembly of the embodiment of FIG. 5 showing the standard magnet field of the magnet assembly.

The preferred embodiment provides two pairs of magnet assemblies, as shown in FIG. 5, wherein each magnet assembly comprises two cylindrical magnets 24 disposed in stacked relationship with respect to one another. Paired spacers 28 are positioned between adjacent magnets 24 and at ends thereof. As shown in FIG. 20, the magnets 24 are oriented with like magnetic poles abutting across intervening spacers 28. Because the individual magnetic segments are poled and positioned in this configuration, with adjacent magnets 24 stacked such that each magnet repels an adjacent magnet 24, a substantial fringing flux is created at the sides of the spacers 28 providing a strong magnetic attraction orthogonal to the longitudinal axis of the mounting rod 27. Although the preferred embodiment utilizes two pairs of cylindrical magnets 24, it is contemplated that alternate magnet shapes and configurations may be utilized with the present invention. For instance, the invention may utilize a single cylindrical magnet 24 rotatably mounted to each end of the second rod 22, as shown in FIG. 11, or a pair of cylindrical magnets 24 as shown in FIGS. 12 and 13–15. Other magnet shapes may also be used, such as bars and disks.

Figure 12:
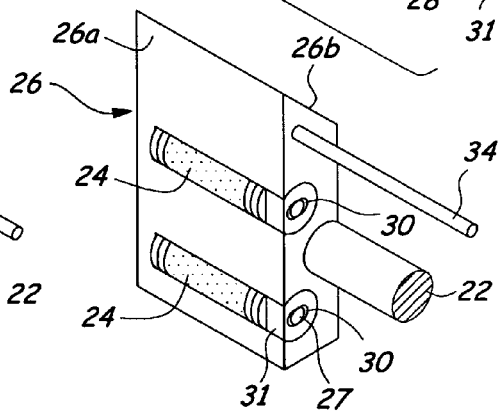
FIG. 12 is a front perspective view of another alternate embodiment of the magnet housing assembly of the present invention.
Figure 13:
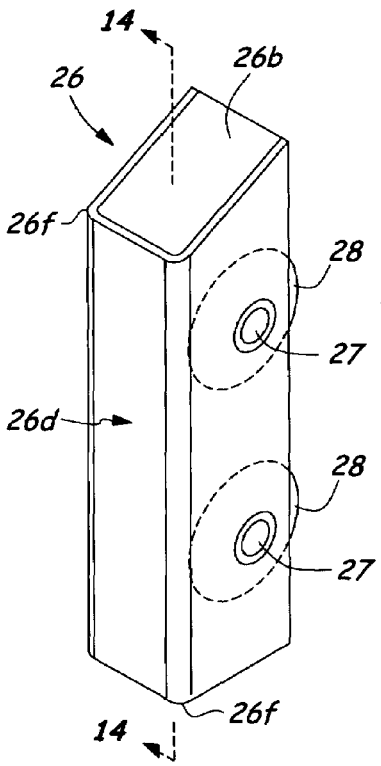
FIG. 13 is a rear perspective view of another alternate embodiment of the magnet housing assembly of the present invention.
Figure 14:
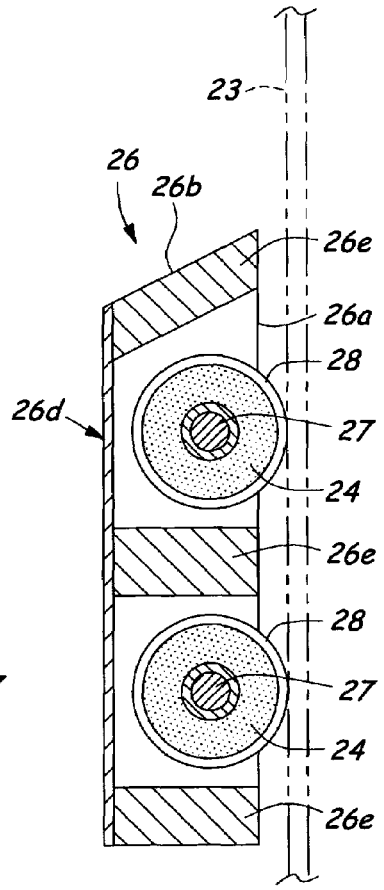
FIG. 14 is a sectional view taken along line 14—14 of FIG. 13.
Figure 15:
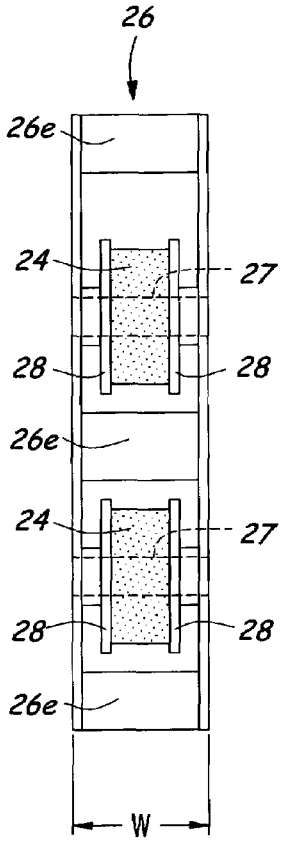
FIG. 15 is a front elevational view of the magnet housing assembly of the embodiment of FIG. 13.

Similarly, the configuration of the housing assembly 26 can vary, as shown by way of example by comparing the housing assembly provided in FIG. 12 with the housing assembly provided in FIGS. 13–15. It can be appreciated that while both of these assemblies provide magnets 24 in the form of a single pair of cylindrical magnets 24, the respective magnets 24 and housing assemblies 26 have different configurations. In comparison to the embodiment of FIG. 12, the magnet housing assembly provided in FIGS. 13–15 has cylindrical magnets 24 having a shorter width as measured along a line parallel to the longitudinal axis of the mounting rod 27 and designated by the letter W in FIG. 15. For this reason, this alternate embodiment may be utlized with a narrower magnetically attractable support surface 23. Unlike the embodiment shown in FIG. 12, this alternate embodiment also has single spacer members 28 at the ends of the magnets 24. Additionally, the alternate embodiment of FIGS. 13–15 has spacer members 28 with larger diameters than the cylindrical magnets 24, as shown most clearly in FIG. 15. This provides for contacting engagement between the outer edge of the spacer members 28 and the lateral margins 13 and 14 without contacting engagement between the magnets 24 and the lateral margins 13 and 14.

An alternate configuration of the housing assembly 26 of the present invention is provided in FIGS. 16–19. This embodiment has a U-shaped housing member 26*d* similar to that provided in the embodiment in FIGS. 13–15. But instead of providing a pair of cylindrical magnets 24, the embodiment in FIGS. 16–19 provides a pair of rectangular magnets 24 mounted in side-by-side relationship within a channel formed by the U-shaped housing member 26*d*. The magnets 24 are interposed between a pair of nonmagnetic rollers 40 mounted within the U-shaped housing member 26*d* on mounting rods 27. In this alternate embodiment, the nonmagnetic rollers 40 are positioned to allow for contacting engagement with the lateral margins 13 and 14 without contacting engagement between the magnets 24 and the lateral margins 13 and 14, as is most clearly shown in FIG. 18.

Preferably, the housing portions of the magnet housing assemblies are configured to provide shielding of the magnetic force, so that the magnetic flux is primarily directed from the forward face 26*a* of the housing assembly 26 perpendicular thereto. This allows the magnet housing assembly 26 to provide discrete areas that contain sufficient magnetic flux density directed to the lateral margins 13 and 14, while minimizing the magnetic flux density emanating from the magnet housing assembly 26 in other directions. In the alternate embodiments shown in FIGS. 13–15 and FIGS. 16–19, the housing portion of the magnet housing assembly 26 is comprised of a longitudinal U-shaped housing member 26*d*, preferably of a magnetically attractable metal. In the embodiment shown in FIGS. 13–15, the housing assembly further comprises transverse structural members 26*e*, preferably of a nonmagnetic plastic, mounted within the channel formed by the U-shaped housing member 26*d*. In this embodiment, as shown in FIG. 14, the two cylindrical magnets 24 are each rotatably mounted within the aforementioned channel between adjacent transverse structural members 26*e*. Both of the embodiments shown in FIGS. 13–15 and FIGS. 16–19 have U-shaped housing members 26*d* with rounded upper corners 26*f* along opposing upper edges of the housing portion rear surface, as shown most clearly in FIGS. 13 and 17. This configuration significantly enhances the shielding of the magnetic force.

Figure 2B:
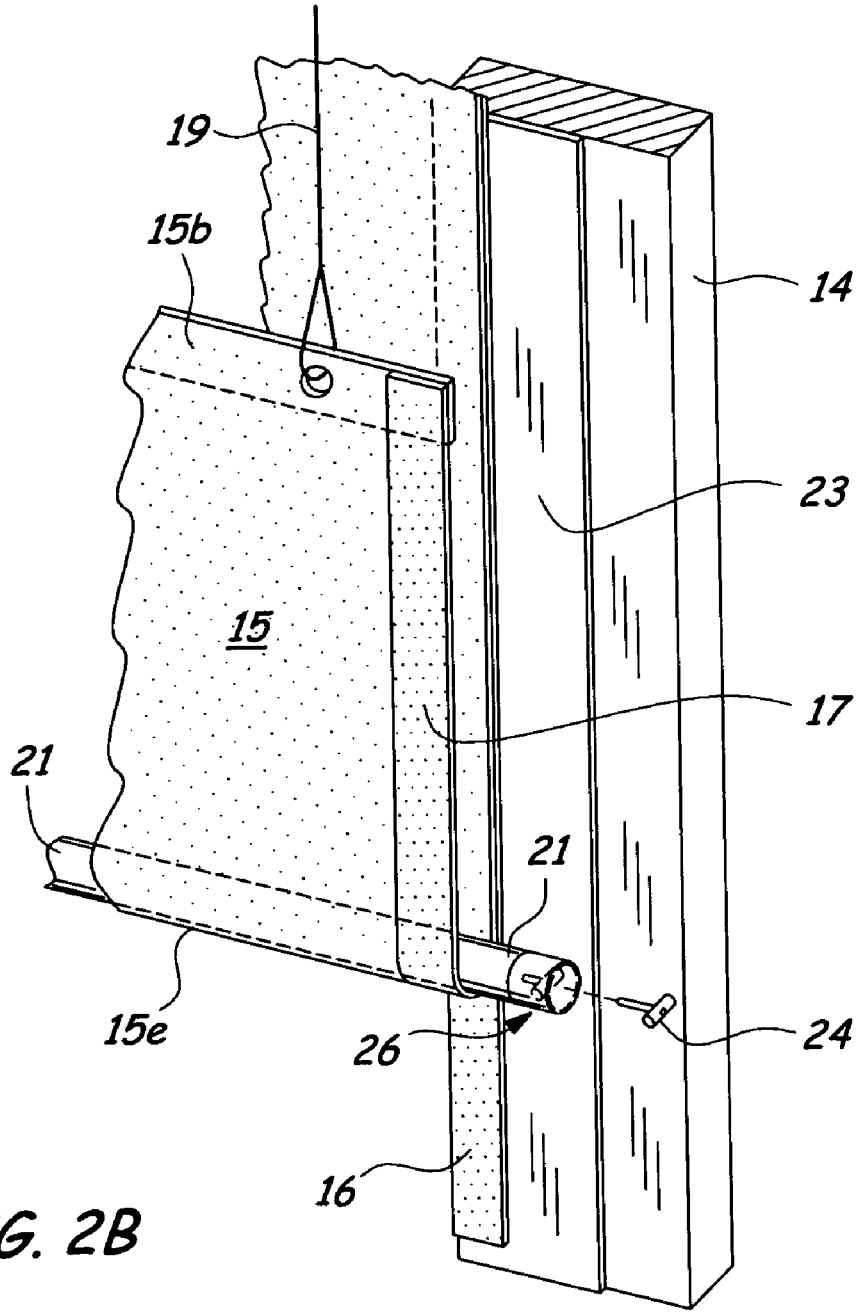
FIG. 2B is an enlarged perspective view of the magnet housing assembly of the embodiment of FIG. 2A.

An alternate embodiment of the present invention is provided in FIGS. 2A and 2B. This embodiment does not include a second elongated rod 22, and provides at least one magnet 24 that is operatively mounted within the first elongated rod 21. More specifically, with reference to FIG. 2B, in this embodiment a magnet 24 is internally disposed within each first elongated rod 21 at opposing ends thereof. The magnet assembly 26 is rotatably mounted so that as the first rod 21 is raised and lowered along the lateral margins 13 and 14, the magnet 24 internally disposed therein will remain in proper magnetic alignment with the magnetically attractable support surface 23 to maintain magnetic connection therewith.

An additional alternate embodiment is provided in FIG. 3. Similar to the embodiment shown in FIGS. 2A and 2B, this embodiment does not include a second elongated rod 22. The embodiment of FIG. 3 provides a means for magnetically urging comprising at least one magnetic strip 35 affixed to each said lateral margins 13 and 14. In this embodiment, the opposing ends of the second rod 22 have a magnetically attractable surface 23 integral therewith or affixed thereto.

It may be appreciated that the various embodiments of the means for magnetically urging may be utilized in the same manner to either urge the second rod 22 toward the lateral margins 13 and 14, when a second rod 22 is utilized, or to urge the first rod 21 toward the lateral margins 13 and 14 when a second rod is not utilized. Thus, for example, the various forms of the aforementioned means for magnetically urging can comprise at least one magnet 24 operatively connected to each opposing end of the first rod 21 when a second rod 22 is not utilized. Each of the embodiments may be used alternatively either to magnetically connect the opposing ends of the first rod 21 to the lateral margins 13 and 14 or to magnetically connect the opposing end of the second rod 22 to the lateral margins 13 and 14 without departing from the scope of invention herein disclosed.

The present invention may be utilized with means for guiding opposing ends of the first or second rod along a path generally parallel to the plane of the lateral margins 13 and 14. In the preferred embodiment, means for guiding comprises a vertical lip 36 positioned along the outer edge of the lateral margins 13 and 14, as shown in FIG. 1B. The lip 36 extends from the lateral margins 13 and 14 to a position extending forward thereof. In the preferred embodiment, the lip 36 is positioned orthogonal to the support surface of the lateral margins 13 and 14. The lip 36 acts a vertical guide for the outer side surface 26*c* of the magnet housing assembly as the curtain 15 is raised and lowered. The lip 36 allows either the first 21 or second 22 rod to travel vertically as pipe 18 is rotated, without pivoting in the horizontal plane about its respective mid point or moving significantly along its respective axis.

Figure 16:
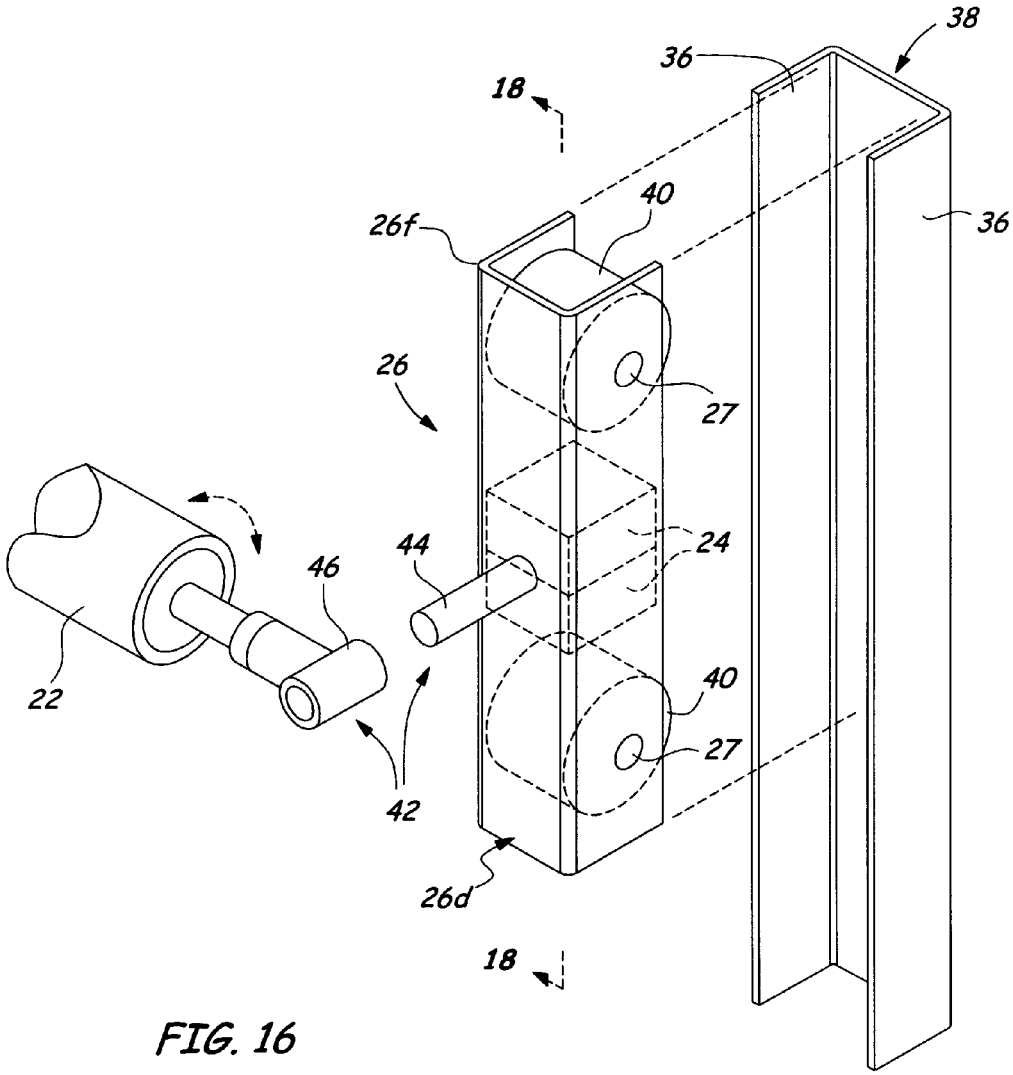
FIG. 16 is an exploded perspective view of a track and another alternate embodiment of the magnet housing assembly of the present invention.
Figure 17:
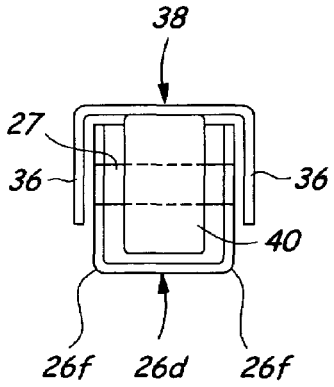
FIG. 17 is a top view of the track and magnet housing assembly of the embodiment of FIG. 16.
Figure 18:
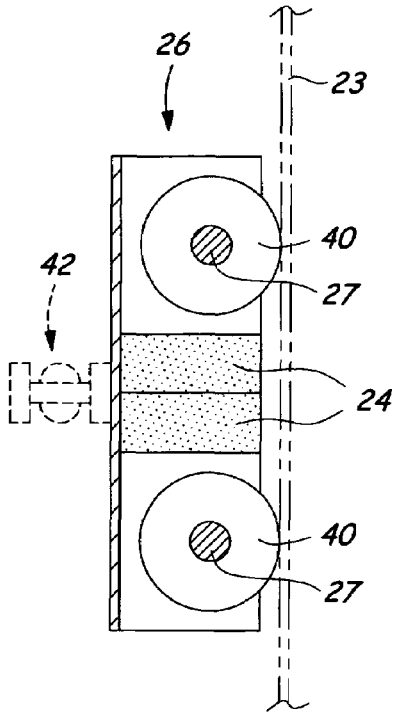
FIG. 18 is a sectional view taken along line 18—18 of FIG. 16.
Figure 19:
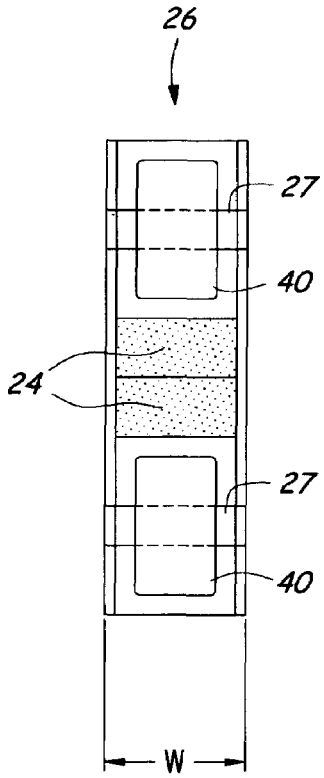
FIG. 19 is a front elevational view of the magnet housing assembly of the embodiment of FIG. 16.

In the embodiment of the present invention provided in FIGS. 16–19, an alternate means for guiding comprises an elongated, generally U-shaped track 38 having a magnetically attractable support surface bounded by opposing vertical lips 36 extending therefrom. In this embodiment, the opposing lips 36 are positioned orthogonal to the magnetically attractable support surface, which may be considered integral with the lateral margins 13 and 14. As shown in FIG. 16, and most clearly in FIG. 17, the housing assembly 26 is disposed within a channel formed by the track 38. The opposing lips 36 of the track 38 act as vertical guides for the outer side surfaces of the magnet housing assembly 26 as the curtain 15 is raised and lowered. The tracks 38 and opposing lip portions 36 thereof allow the first 21 or second 22 rod to travel vertically as pipe 18 is rotated. This embodiment also provides means for pivotally attaching the end of the first 21 or second 22 rod to the magnet housing assembly 26, in the form of a clevis assembly 42. The clevis assembly 42 has a clevis pin 44 extending from an outer surface of the housing assembly 26, and a clevis keeper 46 adapted for receiving the clevis pin 44. The clevis keeper 46 is rotatably mounted to the end of the first 21 or second 22 rod, which allows pivotal movement of the opposing housing assemblies 26 about the first 21 or second 22 rod as the curtain 15 is raised and lowered.

The means for guiding may also comprise opposing channel members having alternate configurations for capturing the opposing ends of the first rod 21 and, if present, the second rod 22. The opposing channel members (not shown) may have the magnetically attractable support surface 23 of the lateral margins 13 and 14 formed integral therewith or otherwise affixed thereto. However, the use of means for guiding such as a lip 36, a track 38, or channel member is optional. The present invention provides means for biasing the pocket formed by the upturned ends of the cover 15 toward the lateral margins 13 and 14, and perpendicular thereto. Thus, the present invention eliminates the reliance on means for guiding as well as reliance on a lateral component of the weight of the first rod 21 or second rod 22 or other lateral biasing means for a portal 11 covering known in the prior art.

The control mechanism may be any of a number of mechanisms depending on the needs of the application of the invention. For example, in a livestock confinement house or warehouse where temperature control is a necessity, the present invention may be used as a cover for a ventilation fan, and as a variable height curtain over a window. In this situation a temperature controller may be attached to each motor for each curtain and constantly monitor the temperature in the house. In this manner, the fans may be uncovered and actuated, and the curtain raised or lowered to meet specific airflow conditions. In another example, the present invention may be used in a greenhouse, having a need to control the amount of sunlight on certain plants during particular months. In this situation, the motor may be controlled by a timer or may be connected to a sensing system connected to a plurality of photocells that incrementally indicate to the motor how much of the curtain should be raised or lowered. Likewise, the opening can be monitored to close during a rain shower. In the simplest case a switch to turn the motor on and off may be provided. Furthermore, limit switches of various kinds may be placed at various locations to further control the movement of the curtain, such that it may eliminate air curtains or the like.

It is ostensibly noteworthy to mention that the present invention is not limited to vertical portals, but can be used with portals ranging from vertical to horizontal or any angle therebetween. Additionally, the present invention is not susceptible to sliding friction between the parts because all of the mating surfaces are contacting each other in a rolling relationship. Therefore, wear on the curtain is minimized, and the drive units do not have to overcome friction to position the curtain. Furthermore, the curtain is not susceptible to jamming due to debris being wedged into sliding engagement with a component since no sliding movement is provided.

It is to be understood that the form of the invention shown is a preferred embodiment thereof and that various changes and modifications may be made therein without departing from the spirit of the invention or scope as defined in the following claims.

What is claimed is:

1. An apparatus for opening and closing a portal in a structure, comprising:

a) a pair of spaced apart opposing lateral margins defining opposing sides of the portal;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) a first elongated rod captured within said pocket;

d) varying means operatively connected to said second end of said curtain for varying the height of said pocket; and e) means for magnetically urging said pocket towards said lateral margins, wherein said means for magnetically urging comprises a magnetic member mounted to each opposing end of said first rod to hold each said opposing end of said rod against a lateral margin.

2. An apparatus as defined in claim 1 wherein each said lateral margin has a magnetically attractable support surface and said means for magnetically urging comprises at least one magnet operatively mounted to each said opposing end of said first rod.

3. An apparatus as defined in claim 2 wherein each said magnetically attractable support surface comprises a metal strip affixed to each said lateral margin.

4. An apparatus as defined in claim 2 wherein each at least one magnet is operatively mounted within each said opposing end of said first rod.

5. An apparatus as defined in claim 2 wherein each at least one magnet is rotatably mounted to each said opposing end of said first rod.

6. An apparatus as defined in claim 5 further comprising a magnet housing assembly rotatably mounted to each said opposing end of said first rod, each said housing assembly having said at least one magnet connected thereto.

7. An apparatus as defined in claim 6 wherein said at least one magnet is a cylindrical magnet having a central bore mounted for rotation about a mounting rod passing therethrough.

8. An apparatus as defined in claim 7 wherein said at least one magnet comprises a plurality of cylindrical magnets, each said magnet having a central bore mounted in axial alignment for rotation about said mounting rod passing therethrough.

9. An apparatus as defined in claim 8 further comprising at least one cylindrical spacer member interposed between two adjacent cylindrical magnets.

10. An apparatus as defined in claim 7 wherein said at least one magnet comprises a first pair of cylindrical magnets having a central bore mounted in axial alignment for rotation about a first mounting rod passing therethrough and a second pair of cylindrical magnets having a central bore mounted in axial alignment about a second mounting rod passing therethrough.

11. An apparatus as defined in claim 6 wherein each said magnet housing assembly has an inclined upper surface.

12. An apparatus as defined in claim 1 further comprising means for guiding said opposing ends of said first rod along a path generally parallel to the plane of said lateral margins.

13. An apparatus as defined in claim 12 wherein said means for guiding comprises opposing channel members.

14. An apparatus for opening and closing a portal in a structure, comprising:

a) a pair of spaced apart opposing lateral margins defining opposing sides of the portal;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) a first elongated rod captured within said pocket;

d) varying means operatively connected to said second end of said curtain for varying the height of said pocket;

e) a second elongated rod supported on and separated from said first elongated rod by said second end of said curtain; and f) means for magnetically urging said pocket towards said lateral margins, wherein said means for magnetically urging comprises a magnetic member mounted to each opposing end of said second rod to hold each said opposing end of said second rod against a lateral margin.

15. An apparatus as defined in claim 14 wherein each said lateral margin has a magnetically attractable support surface and said means for magnetically urging comprises at least one magnet operatively connected to each said opposing end of said second rod, wherein each at least one magnet is operatively mounted within said second rod.

16. An apparatus as defined in claim 14 wherein each said lateral margin has a magnetically attractable support surface and said means for magnetically urging comprises at least one magnet operatively connected to each said opposing end of said second rod, wherein each at least one magnet is rotatably mounted to said second rod.

17. An apparatus as defined in claim 16 further comprising a magnet housing assembly rotatably mounted to each said opposing end of said second rod, each said housing assembly having said at least one magnet connected thereto.

18. An apparatus as defined in claim 17 wherein said at least one magnet is a cylindrical magnet having a central bore mounted in axial alignment for rotation about a mounting rod passing therethrough.

19. An apparatus as defined in claim 18 wherein said at least one magnet comprises a plurality of cylindrical magnets, each said magnet having a central bore mounted in axial alignment for rotation about said mounting rod passing therethrough.

20. An apparatus as defined in claim 19 further comprising at least one cylindrical spacer member interposed between two adjacent cylindrical magnets.

21. An apparatus as defined in claim 18 wherein said at least one magnet comprises a first pair of cylindrical magnets having a central bore mounted in axial alignment for rotation about a first mounting rod passing therethrough and a second pair of cylindrical magnets having a central bore mounted in axial alignment about a second mounting rod passing therethrough.

22. An apparatus as defined in claim 17 wherein each said magnet housing assembly has an inclined upper surface.

23. An apparatus as defined in claim 14 further comprising means for guiding said opposing ends of said second rod along a path generally parallel to the plane of said lateral margins.

24. An apparatus as defined in claim 23 wherein said means for guiding comprises opposing channel members.

25. An apparatus as defined in claim 1 wherein said means for magnetically urging comprises at least one magnetic strip affixed to each said lateral margin.

26. An apparatus for opening and closing a portal in a structures comprising:

a) a pair of spaced apart opposing lateral margins defining opposing sides of the portal, wherein each of said lateral margins has a magnetically attractable support surface;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) a first elongated rod captured within said pocket;

d) varying means operatively connected to said second end of said curtain for varying the height of said pocket; and e) means for magnetically connecting opposing ends of said first rod to said lateral margins, wherein said means for magnetically connecting comprises a magnetic member mounted to each opposing end of said first rod to hold each said opposing end of said first rod against a lateral margin.

27. An apparatus as defined in claim 26 wherein said means for magnetically connecting comprises at least one magnet rotatably mounted to each said opposing end of said first rod.

28. An apparatus as defined in claim 27 wherein said means for magnetically connecting further comprises a magnet housing assembly rotatably mounted to each said opposing end of said first rod.

29. An apparatus for opening and closing a portal in a structures comprising:

a) a pair of spaced apart opposing lateral margins defining opposing sides of the portal, wherein each of said lateral margins has a magnetically attractable support surface;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) a first elongated rod captured within said pocket;

d) varying means operatively connected to said second end of said curtain for varying the height of said pocket;

e) a second elongated rod supported on and separated from said first elongated rod by said second end of said curtain; and f) means for magnetically connecting opposing ends of said second rod to said lateral margins, wherein said means for magnetically connecting comprises a magnetic member mounted to each opposing end of said second rod to hold each said opposing end of said second rod against a lateral margin.

30. An apparatus as defined in claim 29 wherein said means for magnetically connecting comprises at least one magnet rotatably mounted to each said opposing end of said second rod.

31. An apparatus as defined in claim 30 wherein said means for magnetically connecting further comprises a magnet housing assembly rotatably mounted to each said opposing end of said second rod.

32. An apparatus for opening and closing a portal in a structures comprising:

a) a pair of spaced apart opposing lateral margins defining opposing sides of the portal, wherein each of said lateral margins has a magnetically attractable support surface;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) a first elongated rod captured within said pocket, said first rod having opposing ends;

d) varying means operatively connected to said second end of said curtain for varying the height of said pocket; and e) at least one magnet operatively connected to each said opposing end of said first rod to hold each said opposing end of said first rod against a lateral margin with said at least one magnet providing discrete areas that contain sufficient magnetic flux density to retain each said end of said first rod to said magnetically attractable surface of said lateral margin.

33. An apparatus as defined in claim 32 wherein said at least one magnet is rotatably mounted to said first rod.

34. An apparatus as defined in claim 33 wherein said at least one magnet is cylindrical.

35. An apparatus for opening and closing a portal in a structures comprising:

a) a pair of spaced apart opposing lateral margins defining opposing sides of the portal, wherein each of said lateral margins has a magnetically attractable support surface;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) a first elongated rod captured within said pocket;

d) varying means operatively connected to said second end of said curtain for varying the height of said pocket;

e) a second elongated rod supported on and separated from said first elongated rod by said second end of said curtain; and f) at least one magnet operatively connected to each opposing end of said second rod to hold each said opposing end of said second rod against a lateral margin with said at least one magnet providing discrete areas that contain sufficient magnetic flux density to retain each said end of said second rod to said magnetically attractable surface of said lateral margin.

36. An apparatus as defined in claim 35 wherein said at least one magnet is rotatably mounted to said second rod.

37. An apparatus as defined in claim 36 wherein said at least one magnet is cylindrical.

38. An apparatus for opening and closing a portal in a structure, comprising:

a) a pair of spaced apart opposing lateral margins defining opposing sides of the portal, wherein each of said lateral margins comprises a magnetically attractable material;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) varying means operatively connected to said second end of said curtain for varying the height of said pocket; and d) an elongated rod having a magnetic member mounted to each opposing end of said rod to hold each said end of said rod against a lateral margin, wherein said curtain is between said rod and said lateral margins.

* * * * *